United States Patent [19]

Knapp

[11] Patent Number: 4,506,401

[45] Date of Patent: Mar. 26, 1985

[54] BRISTLE PIG CUP

[76] Inventor: Kenneth M. Knapp, 1209 Hardy, Houston, Tex. 77020

[21] Appl. No.: 570,994

[22] Filed: Jan. 16, 1984

[51] Int. Cl.[3] ..... B08B 9/04

[52] U.S. Cl. ..... 15/104.06 R

[58] Field of Search ..... 15/104.06 R, 104.06 A, 15/3.5, 3.51; 134/8; 166/170, 173, 177, 202

[56] References Cited

U.S. PATENT DOCUMENTS

| | | | |
|---|---|---|---|
| 1,756,378 | 4/1930 | Oberhuber | 15/104.06 R |
| 3,107,379 | 10/1963 | Hill | 15/104.06 R |
| 4,077,079 | 3/1978 | Knapp | 15/104.06 R |
| 4,275,475 | 6/1981 | Schwartz | 15/104.06 R |

*Primary Examiner*—Edward L. Roberts

*Attorney, Agent, or Firm*—Gunn, Lee & Jackson

[57] ABSTRACT

For use with a mandrel supporting a plurality of cups, an improved pipeline pigging cup is set forth in the preferred and illustrated embodiment. The cup is equipped with a large protruding lip around the periphery, and has a reinforcing member in the lip to secure the lip in a resilient fashion against the surrounding pipeline. The reinforcing member is formed of a strip of cloth backing with upstanding staples in the form of a multitude of small staple tips; the tips are arranged at or near the surface of the lip, thereby defining an abrasion resistant surface.

7 Claims, 2 Drawing Figures

BRISTLE PIG CUP

BACKGROUND OF THE DISCLOSURE

In pipeline pigging operations, it is necessary to periodically replace cups on a pigging mandrel. A pigging mandrel is an elongate body used to support two or more cups. The cups are equipped with a laterally extending central portion, having a peripheral lip around the edge, the lip sealing against the pipe. As the pig is forced through the pipeline, the lip on the cup holds a seal so that pressure fluid behind the mandrel pig forces the entire assembly along the pipe, and accomplishes the necessary pigging action to clean the pipe. Wear is localized at the lip on the replaceable cups. As wear occurs, fluid bypass begins to occur, thereby reducing the cleaning effect of the pig. It also slows down the rate of travel as additional fluid is bypassed. There is a chance that the lip will wear partially, thereby settling toward the bottom of the pipe and distributing the wear on the lip of the cup unevenly around the periphery. As these problems occur, they are cumulative. One cure is to reinforce the lip of the cup. For instance, U.S. Pat. No. 4,365,379 shows a mandrel type pipe with a plurality of cups thereon wherein the cups are flared outwardly by the backing plates adjacent to the cups. An alternate form of reinforcing the lip of the cup is to include reinforcing gussets on the back face of the cup just beneath the lip. This is shown in the patent of Kidd, U.S. Pat. No. 3,480,984. Various and sundry reinforcing or stiffening plates are known.

An alternate approach is to place more resilient material in the lip. However, doubling the thickness of the lip does not necessarily produce twice the life in the pig. In instances, it may simply make the lip stiffer and therefore subject to faster wear. Another reference of interest is U.S. Pat. No. 4,077,079 which shows an abrasion material placed on a bullet-shaped pig body. Various and sundry abrading materials are known including tungsten carbide particles applied in mixed particle sizes either in strips or entirely across the face of elongate bullet-shaped pigs. When placed in strips spiraling around the pig body, they impart twist or rotation to cause the pig to spin as it travels the pipeline, thereby distributing wear around the full surface of the pig. As will be understood, bullet-shaped pig bodies do not use replacement cups, and when worn, the entire pig must be disgarded.

By contrast with the foregoing, a submerged stiffening member integrally cast in the peripheral lip of the replacement cup is set forth in this disclosure as a means of providing longer life in replacement cups. The replacement cup is reinforced by a stiffening member. The preferred form of the stiffening member must be slightly flexible or bendable before casting. It is preferably placed in the mold at the time of casting the replacement cup. Some degree of stiffening is obtained by merely placing the stiffening member in the mold, even should it be located so that it is not near or at the surface of the finished pig cup. The preferred form of stiffening is formed of multiple layers, typically between two and five layers, of heavy cloth of ducking. They are formed together in a strip so that the strip can be cut to length, enabling the proper length to be coiled in the mold before casting. The ducking supports uniformly and regularly positioned staples having staple points. This material is often available in the textile industry and is used in that industry as carding cloth. It has been discovered that the replacement cup of this disclosure can be markedly enhanced in its performance (referring to the number of miles of pipe that can be cleaned by a particular cup before the cup must be disgarded) and gains of perhaps 100% or 200% are not uncommon in contrast with replacement cups not constructed in the mode of this disclosure.

As will be understood on review of the disclosed embodiment, the strip of carding cloth is positioned in the mold at the time of integrally casting the replacement cup. After the unset plastic material has been placed in the mold, the final product which is formed is a replacement cup having a peripheral lip wherein the lip is reinforced by the circular reinforcing member. Thus, if the pipeline has a 24 inch diameter, the replacement cup will have a nominal 24 inch size equipped with a surrounding lip of about 3 or 4 inches in width and a thickness of about ½ to 1 inch in thickness. On the inside of that lip, and integrally constructed with it, the reinforcing member is located, then holding the lip stiff somewhat in the fashion of a hoop or reinforcing bead in the lip.

One feature of the present disclosure is the incorporation of a stiffening hoop in the replacement cup lip. The reinforcing hoop enables the cup to yield during operation, but yielding is not so severe as to distort the lip and thereby prevent leakage past the pig during cleaning operation. The abrading surface is reinforced at or in the near vicinity of the tips of the staples which are carried in the carding cloth. Those staples are submerged beneath the surface of the cup lip, thereby forming a part of the body of the cup.

In the preferred embodiment, the peripheral lip has an internally cast hoop like member which stiffens it, and further includes a multitude of staple legs extending radially outwardly of the completed lip. The staple legs define an abrasion surface cooperative with the elastomeric material used in fabrication of the cup thereby obtaining longer life as an abrasion surface. As will be understood from this cursory summary and in greater detail on explanation below, the replacement cup thus has a stiffer lip able to last longer in operation.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
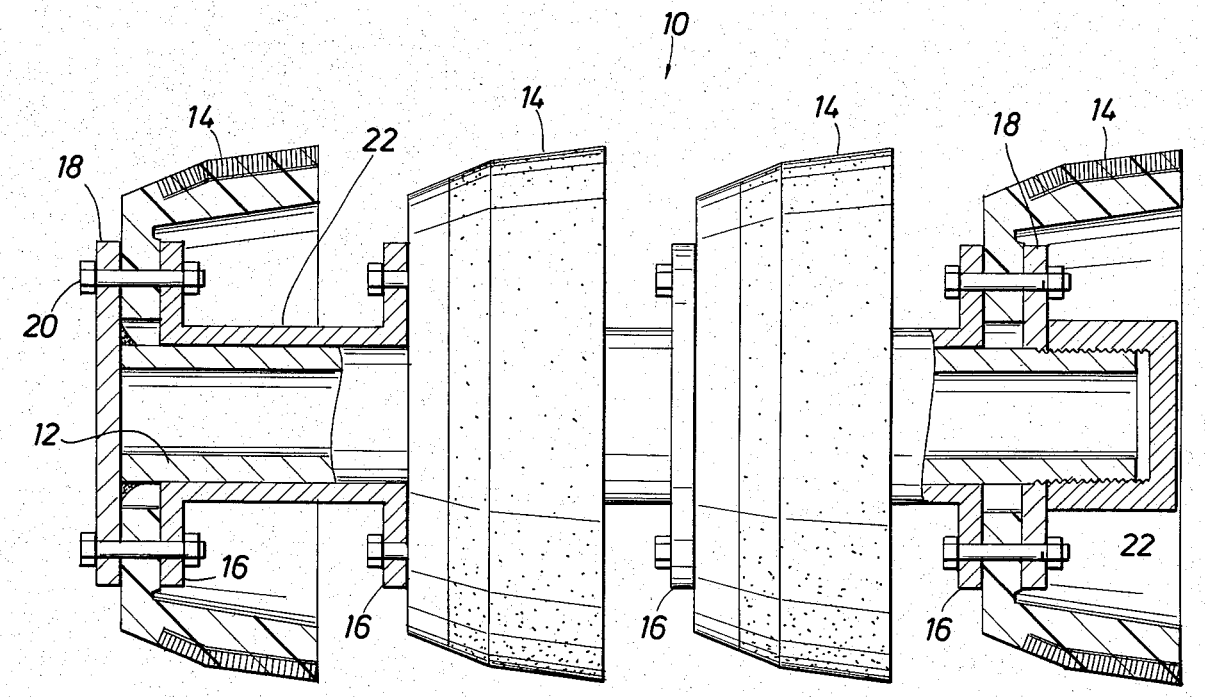
FIG. 1 shows a mandrel pig in section wherein replacement cups are mounted on the mandrel pig.

Attention is first directed to FIG. 1 of the drawings where the numeral 10 identifies a mandrel pig. The mandrel 12 is an elongate metal member, typically sized to support four cups. The mandrel 12 supports a set of backing plates 16 and 18. They are metal discs, having a central hole to enable them to fit onto the mandrel 12, and they sandwich a replacement cup 14. The cup 14 is fastened to the metal discs 16 and 18 by a set of tie bolts 20. The tie bolts 20 fasten around the metal disc, perhaps four to eight bolts utilizing suitably sized drilled holes aligning the discs and cup for mounting. A spacer sleeve 22 separates each cup and backing discs to thereby enable the stack of components to be placed on the mandrel 12.

The foregoing describes the mounting of one cup on the mandrel. Typically four but sometimes a different number can be placed on the mandrel. The mandrel, after the cups have been assembled thereon, is placed in a pipeline and moves along the pipe so that the cups wipe the pipe and pressure fluid drive behind the mandrel moves the pig along the pipeline.

Figure 2:
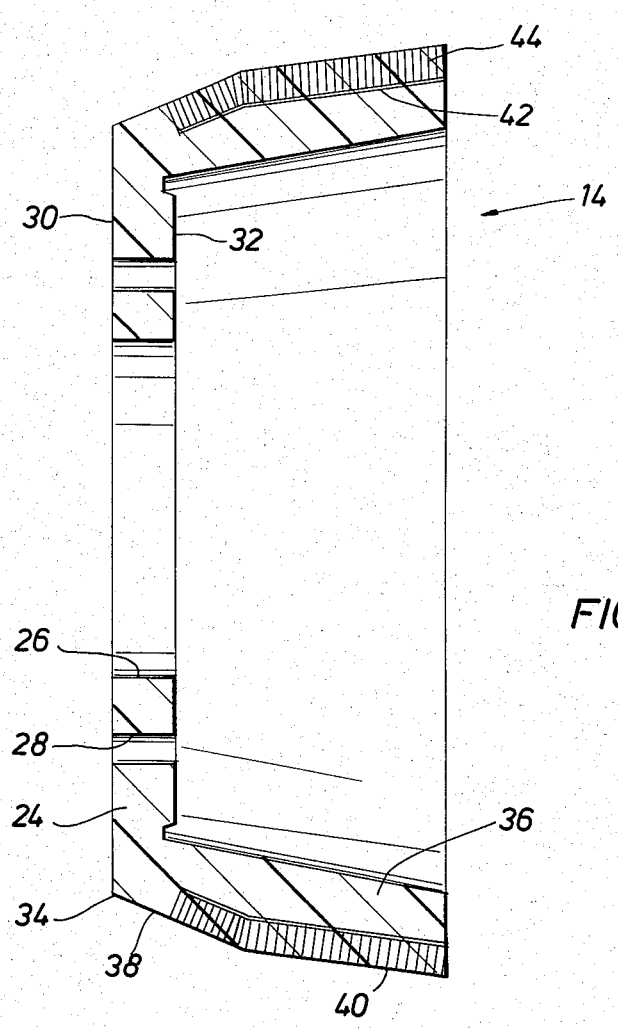
FIG. 2 is a sectional view through a mandrel cup constructed in accordance with the teachings of this disclosure including a hoop located in the lip on a conic taper.

In FIG. 2 of the drawings, the cup is shown in sectional view. The cup 14 incorporates a tranverse central webb portion 24. That webb portion extends inwardly to a central hole at 26. This hole is sized to fit around the mandrel 12. It is adjacent to a set of bolt circle holes 28. Several such bolt holes are included and are arranged on a circle to coincide with the location of the bolts 20. The several holes enable the tie bolts 20 to be fastened to the reinforcing metal disc. This enables the metal discs to be pulled snugly against the cup. The cup is equipped with parallel transverse faces 30 and 32 which sealingly abut against the reinforcing discs. The two reinforcing discs seal against the cup, thereby preventing leakage past the replacement cup in the area of the mandrel or through the bolt holes 28.

The central webb portion 24 extends radially outwardly to a diameter almost matching that of the pipe. If the pipe has a nominal diameter of twenty-four inches, the central webbing extends outwardly to a leading edge 34 which is almost full gauge. There is however a flared lip 36 extending to the rear of the cup. It is constructed as a portion of a conic, typically having a taper between three and ten degrees. The lip typically has a thickness of perhaps one-half to one inch on a twenty-four inch diameter cup. The lip has a width of about three or four inches on a twenty-four inch cup. The lip need not be much wider than four inches even on larger sizes.

As shown in FIG. 2, the lip incorporates a first externally located chamfered face 38. A second face 40 is also included at a lesser angle. The face 40 is more or less parallel to the internal face of the lip, thereby defining a uniform lip thickness in the back portions of the lip. The chamfer at 38 has been exaggerated in width to show the chamfer. At the forward edge 34, the lip is much thicker and tends to be somewhat stiffer because it is adjacent to the central webb 24. The chamfer covers a width of about one quarter to one inch or more and is included to enable the lip to pass smoothly over internal upsets in the pipeline. For instance, when the pipe wall thickness changes, there is a slight upset on the interior. There is also an upset at the internal welding bead where the pipe joints are welded to one another. There may also be an internal upset where the pipeline joins to a valve or other fitting welded in the pipeline.

Preferably, the cup is made of polyurethane. That is a very acceptable material for fabrication of cups. The cup is formed to a suitable hardness by controlling the formulation of the elastomeric material. Needless to say, other types of plastic can be used in the fabrication of the cup. The cup is formed by molding in a mold, this requiring a cure interval. Before pouring the liquid elastomeric material into the mold, a reinforcing hoop is placed in the mold. The reinforcing hoop in this instance is formed of a circle of carding cloth material. It has a canvas backing 42 and supports a set of multitudinous parallel staple legs at 44. This hoop is sized where the hoop is at the outer face of the lip 36, and is not at the inside face. The hoop is positioned in the mold before pouring. The hoop sets immediately adjacent to the mold face which faces the chamfered external face 38 and the outer face 40. The hoop is tapered slightly to accomodate the taper of the lip 36. After positioning in the mold so that it is at the back end of the lip (not near the lip edge 34), the hoop is thus positioned so that it encounters the bulk of the abrasion in conjunction with the cast lip after construction. At this juncture, the liquid resin is poured into the mold. On pouring, the liquid resin completely surrounds the reinforcing hoop. The reinforcing hoop is thus integrally submerged and cast into the finished plastic body.

The finished product at first glance does not particularly appear to be different from any other replacement cup. At most, only the tips of the staple legs 44 are at the surface. They are relatively small, and typically do not show. This is because the cast polyurethane body completely encloses the reinforcing hoop and staple legs. Even where the staple legs actually extend to the exposed face, they do not protrude through the face and are not otherwise visible to casual inspection. The cloth backing of the hoop forms a reinforcing ring. So to speak, it is a stiffener which provides a stiffness to the lip 36 surprisingly beyond what would be expected from a cloth backing. In addition, the staples 44 improve the abrasion resistant characteristic of the lip. Not only is that accomplished, but the staples serve as a spacer to locate the backing at a specified distance from the outer face 40. If for instance the staples have one-half inch length, the backing 42 is submerged in the lip by that distance.

As will be noted, the outer faces 38 and 40 are chamfered. This causes the backing material 42 to bend or slightly curve. This is certainly permissible in the construction of the cup 14. As will be understood, the reinforcing material has a uniformed width such as two inches. It is made by cutting a strip, shaping it into a circle and positioning in the mold before casting. The two ends of the strip are simply abutted against one another in the mold, overlap being unneeded. No particular weakness is formed at this butt joint.

In operation, the cup 14 is bolted to the mandrel 12 shown in FIG. 1. This initially sets up the mandrel pig for use. When it is placed in the pipeline, it travels the full length of the pipeline with the face 40 in contact with the pipe. Occasionally, the chamfered face 38 might even contact the surface. Wear is encountered by abrasion. The resilient material is worn away at the face 40. Eventually, the material which is worn away exposes ever so slightly the staple tips. They also are worn away. However, they are worn away more slowly, being more resistant to abrasion than the elastomeric pig body. This provides greater life. Leakage past the cup is avoided because the cup lip is relatively stiff. There is of course a balance in stiffness. A metal ring in the lip would provide a lip which is unduly stiff and which would not perform as well. There is a balance between undue stiffness and undue abrasion resistant. It has been found that the polyurethane lip of perhaps one-half to one inch thickness (for the twenty-four inch cup) in conjunction with the somewhat pliant reinforcing hoop yields a device which performs exceedingly well in contrast with a monolithic polyurethane cup body. Performance by contrast shows a remarkable improvement in cup life. This is reflected by the ability of the cup to last for perhaps 100% to 200% greater distances in comparable pipelines.

As can be understood, the pig cup of this invention has been described insofar as the preferred embodiment is concerned above and the scope thereof is determined by the claims which follow.

What is claimed is:

1. An improved pipeline cleaning mechanism comprising:

(a) an elongate supporting mandrel having a specified length and adapted to receive and support thereon at least a pair of mountable cups; and (b) wiper cups mountable on said mandrel, said cups having a peripheral lip around a central transverse webb within said lip, said cup being formed of a resilient material sized to fit within a pipeline and sufficiently flexible to forming an encircling sealing contact with the surrounding lip, and wherein said lip integrally comprises a stiffening means in said lip, and said stiffening means extends arcuately of said mandrel to stiffen said lip, and wherein said stiffening means is an elongate backing having a set of staples arranged to extend radially outwardly, and said lip is integrally cast around said staples, locating tips of said staples at or below the surface of said lip.

2. The apparatus of claim 1 including a backing for said staples capable of receiving liquid resin on casting of said cup lip and wherein said backing and staples become bonded into said lip on casting of said lip.

3. The apparatus of claim 2 wherein said backing is formed into a circle with said staples defining a surface coincident with an external peripheral lip surface.

4. The apparatus of claim 3 wherein said lip surface is a portion of a conic.

5. The apparatus of claim 3 wherein said lip surface is two separate conic surfaces.

6. The apparatus of claim 5 wherein said backing is cast in said lip, and has the form of an encircling hoop.

7. A replacement, mountable cup for a mandrel pig for transfer along a pipeline, comprising a cup having a central mandrel engaging hole, said cup having a peripheral lip around a central transverse webb within said lip and surrounding said hole, said cup being formed of a resilient material sized to fit within a pipeline and sufficiently flexible to forming an encircling sealing contact with the surrounding lip, and wherein said lip integrally comprises a stiffening means in said lip, and said stiffening means extends arcuately of said mandrel to stiffen said lip, and wherein said stiffening means is an elongate backing having a set of staples arranged to extend radially outwardly, and said lip is integrally cast around said staples, locating tips of said staples at or below the surface of said lip when new.

* * * * *